US009910397B2

(12) United States Patent
Kamimori

(10) Patent No.: US 9,910,397 B2
(45) Date of Patent: Mar. 6, 2018

(54) IMAGE FORMING APPARATUS WITH SPEED DIFFERENCE CONTROL

(71) Applicant: CANON KABUSHIKI KAISHA, Tokyo (JP)

(72) Inventor: Yasuki Kamimori, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/190,348

(22) Filed: Jun. 23, 2016

(65) Prior Publication Data

US 2016/0378053 A1 Dec. 29, 2016

(30) Foreign Application Priority Data

Jun. 25, 2015 (JP) ..... 2015-127845

(51) Int. Cl.
*G03G 15/00* (2006.01)
*G03G 21/00* (2006.01)

(52) U.S. Cl.
CPC ..... *G03G 21/0035* (2013.01)

(58) Field of Classification Search
USPC .... 399/38, 71, 123, 343, 346, 350, 353, 358
See application file for complete search history.

(56) References Cited

U.S. PATENT DOCUMENTS 6,480,695 B2 * 11/2002 Endo ..... G03G 21/0005 399/349
6,507,724 B2 1/2003 Tamura et al.
7,593,682 B2 * 9/2009 Tokumasu ..... G03G 21/0094 399/343
7,751,752 B2 7/2010 Komatsu
7,907,883 B2 * 3/2011 Thayer ..... G03G 21/0035 399/343
8,364,069 B2 * 1/2013 Arai ..... B08B 1/00 399/346

(Continued)

FOREIGN PATENT DOCUMENTS

JP H10-254323 A 9/1998
JP 2001-100610 A 4/2001

(Continued)

OTHER PUBLICATIONS

U.S. Appl. No. 15/194,756, filed Jun. 28, 2016.
U.S. Appl. No. 15/194,862, filed Jun. 28, 2016.

*Primary Examiner* — Hoan Tran
(74) *Attorney, Agent, or Firm* — Fitzpatrick, Cella, Harper & Scinto

(57) ABSTRACT

An image forming apparatus includes a rotatable image bearing drum; a toner image transfer device; a cleaning blade for cleaning the drum after transfer of the image; a rotatable furbrush provided downstream of the transfer device and upstream of the blade, the furbrush being rotatable counterdirectionally with respect to a peripheral movement of the drum; an executing portion for executing a first mode for forming an image on the transfer material on the basis of a signal inputted to the apparatus and a second mode for supplying a band of the toner to the blade; and a controller for controlling a peripheral speed difference between the drum and the furbrush, wherein the difference when the band of the toner passes the furbrush in the second mode is smaller than that when the toner on the drum after the image transfer passes the furbrush in the first mode.

9 Claims, 6 Drawing Sheets

(56) References Cited

U.S. PATENT DOCUMENTS 8,634,737 B2 * 1/2014 Nakaegawa ..... G03G 21/0035
399/350

FOREIGN PATENT DOCUMENTS

| | | | |
|---|---|---|---|
| JP | 2001-282010 | A | 10/2001 |
| JP | 2008-129066 | A | 6/2008 |
| JP | 2014-224909 | A | 12/2014 |

* cited by examiner (a)

(b)

IMAGE FORMING APPARATUS WITH SPEED DIFFERENCE CONTROL

FIELD OF THE INVENTION AND RELATED ART

The present invention relates to an image forming apparatus such as a printer, a copying machine, a facsimile machine or the like.

An image forming apparatus is known in which a toner image carried on an image bearing member is transferred onto a transfer medium from the image bearing member by transferring means to form an image. In the image forming apparatus, a cleaning blade is contacted to a surface of the image bearing member having passed the transferring means to remove and collect the deposited matter such as untransferred toner on the surface of the image bearing member.

The cleaning blade cleans the surface of the image bearing member in a state that a small amount of toner and/or fine particles exist at the free end thereof to assure the lubrication between the cleaning blade and the surface of the image bearing member. With the shortage of the toner and/or fine particle stagnating at the free end of the cleaning blade, a frictional resistance increases between the cleaning blade and the image bearing member, with the result of vibration and/or damage of the blade edge.

In view of this, in the image forming apparatus, a toner image for supplying the toner at the blade edge is formed on the image bearing member periodically (supply mode) to prevent the shortage of the toner stagnating at the free end of the cleaning blade (Japanese Laid-open Patent Application 2001-282010).

On the other hand, if the toner and/or fine particles are solidified on the surface of the image bearing member, the toner and/or the fine particles could not be collected only by the cleaning blade. Therefore, a rotational cleaning member is provided upstream of the cleaning blade with respect to the rotational moving direction of the image bearing member to remove the solidified toner and/or fine particles by rubbing the surface of the image bearing member with the rotational cleaning member.

In Japanese Laid-open Patent Application 2008-129066, a rotatable brush is provided upstream of the charging roller of a charging device. Here, by decreasing the rotational speed of the rotatable brush contacted to the image bearing member, the toner is accumulated in the rotatable brush, and by increasing the rotational speed of the rotatable brush, the toner is discharged from the rotatable brush onto the image bearing member.

It has been found that in the image forming apparatus in which the rotational cleaning member is disposed upstream of the cleaning blade as disclosed in Japanese Laid-open Patent Application Hei 10-254323, when the toner image for the toner supply is formed, a sufficient amount of the toner supply to the free end of the cleaning blade is not accomplished. Before reaching the cleaning blade, a part of the toner of the toner image for the toner supply is removed from the image bearing member by the rotational cleaning member.

SUMMARY OF THE INVENTION

Accordingly, it is an object of the present invention to provide an image forming apparatus with which a cleaning performance during the image forming operation is enhanced, and simultaneously, the efficiency of the toner supply to the cleaning blade is also enhanced.

According to an aspect of the present invention, there is provided an image forming apparatus comprising a rotatable image bearing member configured to carry a toner image; a transfer device configured to transfer the toner image from said image bearing member onto a transfer material; a cleaning blade configured to remove toner from said image bearing member after transfer of the image; a rotatable fur brush provided at a position downstream of said transfer device and upstream of said cleaning blade with respect to a rotational moving direction of said image bearing member, said fur brush being rotatable to provide a peripheral moving direction thereof counterdirectional with respect to a peripheral moving direction of said image bearing member; an executing portion capable of executing an operation in a first mode for forming an image on the transfer material on the basis of an image formation signal inputted to said image forming apparatus and in a second mode for supplying a band of the toner to said cleaning blade; and a controller configured to control a peripheral speed difference between said image bearing member and said fur brush, wherein the peripheral speed difference between said image bearing member and said fur brush when the band of the toner passes said fur brush in the second mode is smaller than the peripheral speed difference between said image bearing member and said fur brush when the toner on said image bearing member after the image transfer passes said fur brush in the first mode.

Further features of the present invention will become apparent from the following description of exemplary embodiments with reference to the attached drawings.

Figure 3:
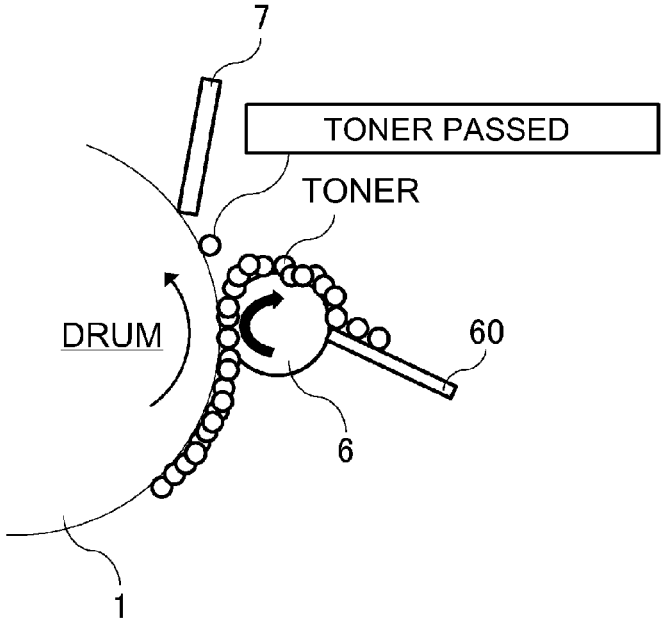
Figure 3:
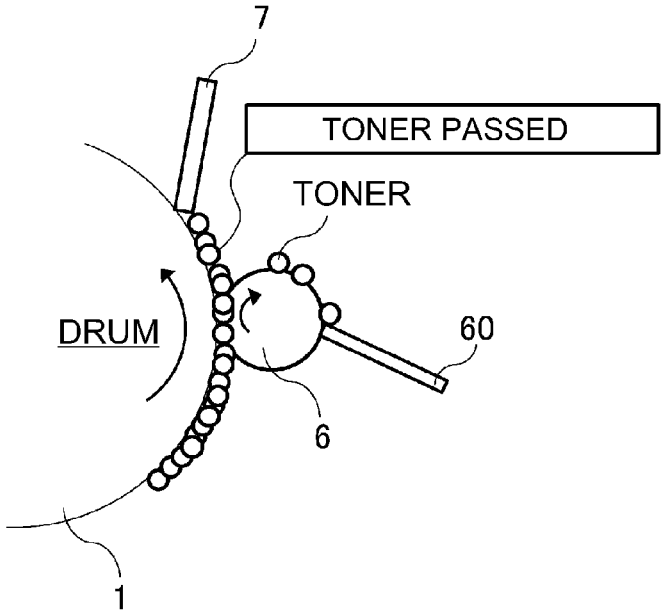

Part (a) of FIG. 3 illustrates an operation of a drum cleaning device in a measurement mode, and part (b) of FIG. 3 illustrates an operation of a drum cleaning device in a toner supply mode.

Figure 4:
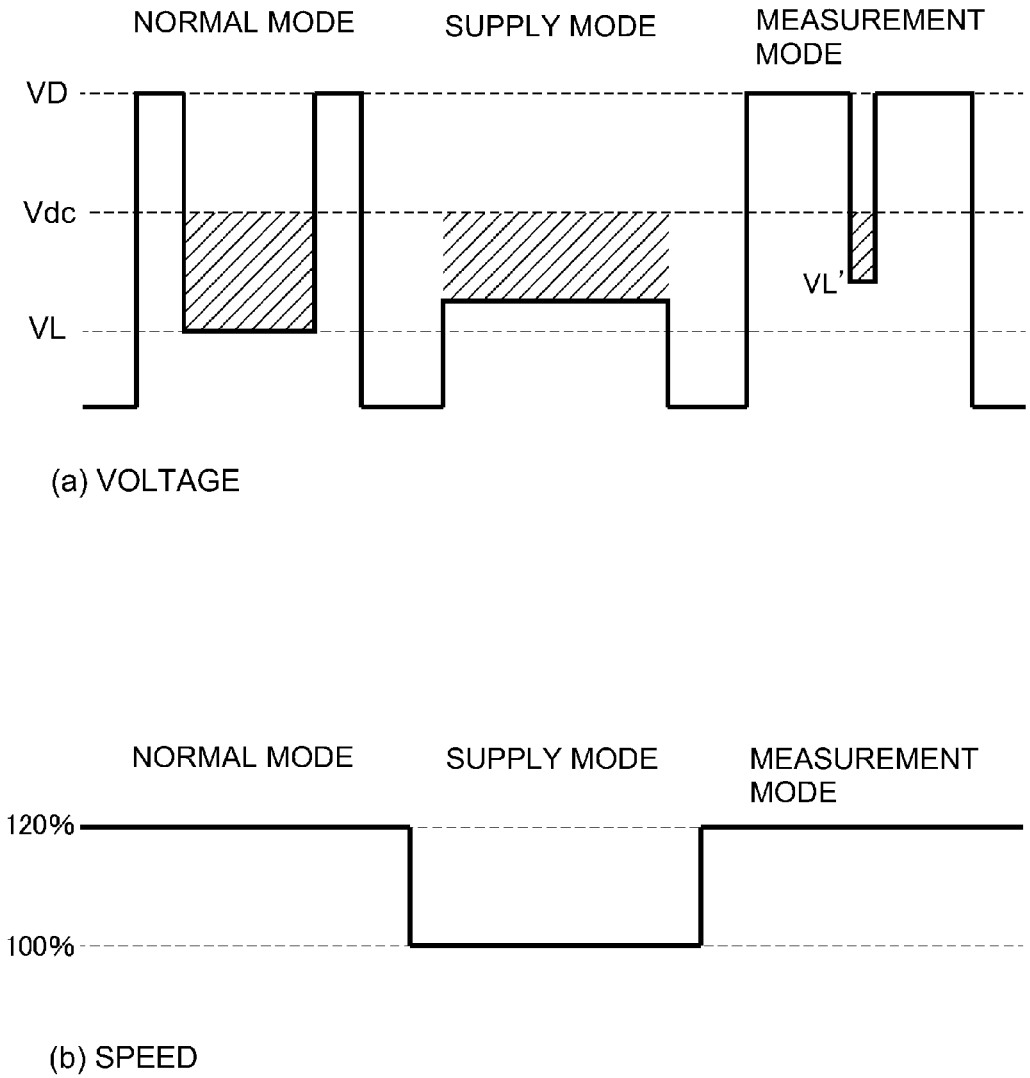

Part (a) of FIG. 4 illustrates a normal toner image, a toner image for measurement and a toner image for the toner supply and compares the applied voltages, and part (b) compares the peripheral speeds of the fur brush.

Figure 5:
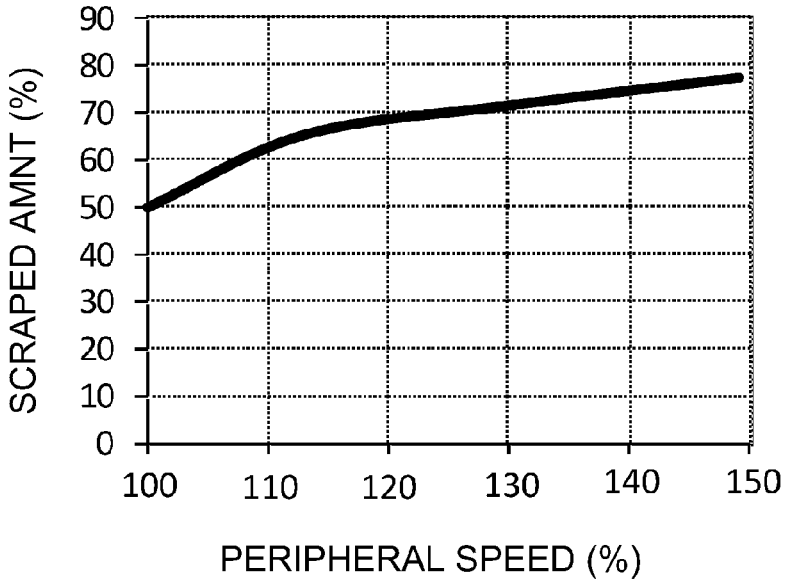

FIG. 5 shows a relationship between a peripheral speed difference between a fur brush and a photosensitive drum and a toner scraping amount.

Figure 6:
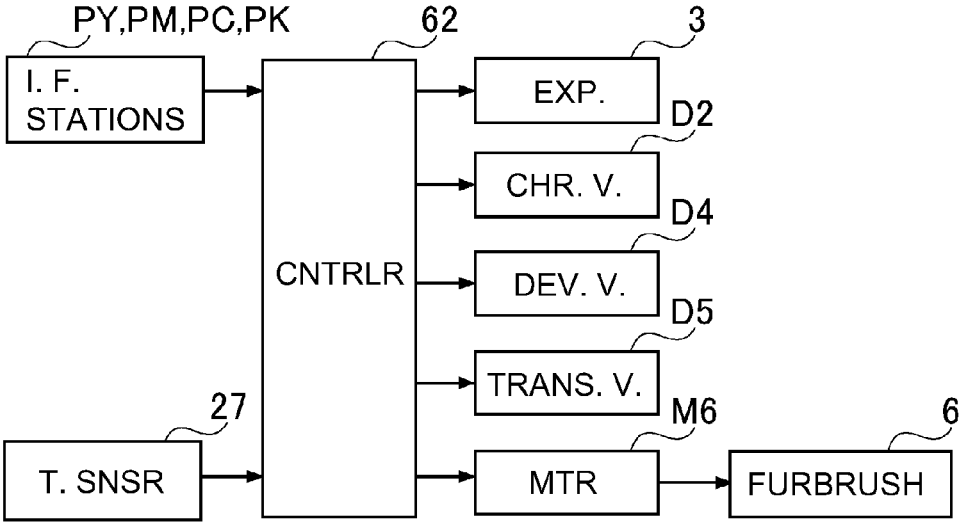

FIG. 6 is a block diagram of a control system for the image forming apparatus.

Figure 7:
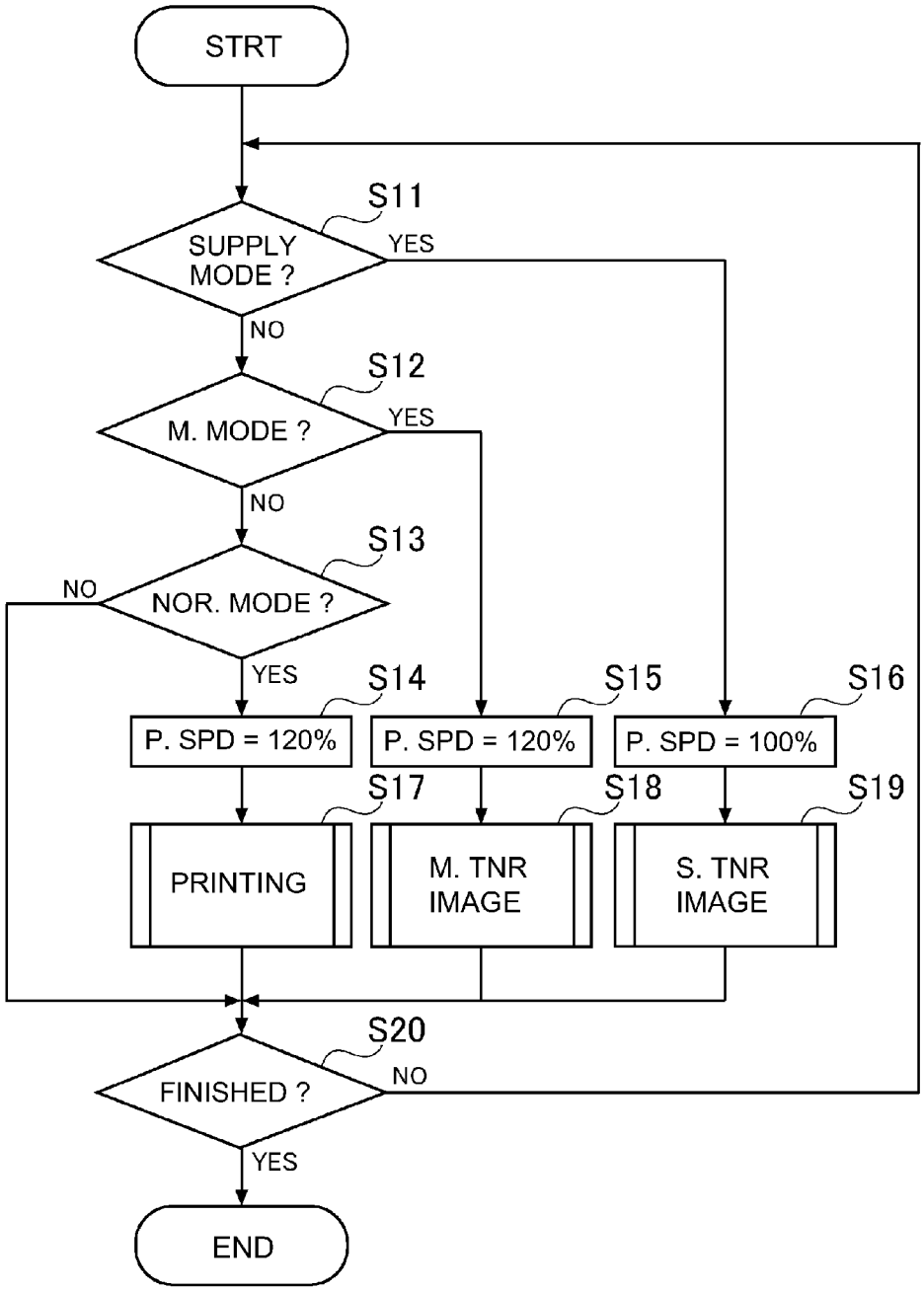

FIG. 7 is a flow chart of the control in Embodiment 1.

DESCRIPTION OF THE EMBODIMENTS

Referring to the accompanying drawings, embodiments of the present invention will be described.

Embodiment 1

(Image Forming Apparatus)

Figure 1:
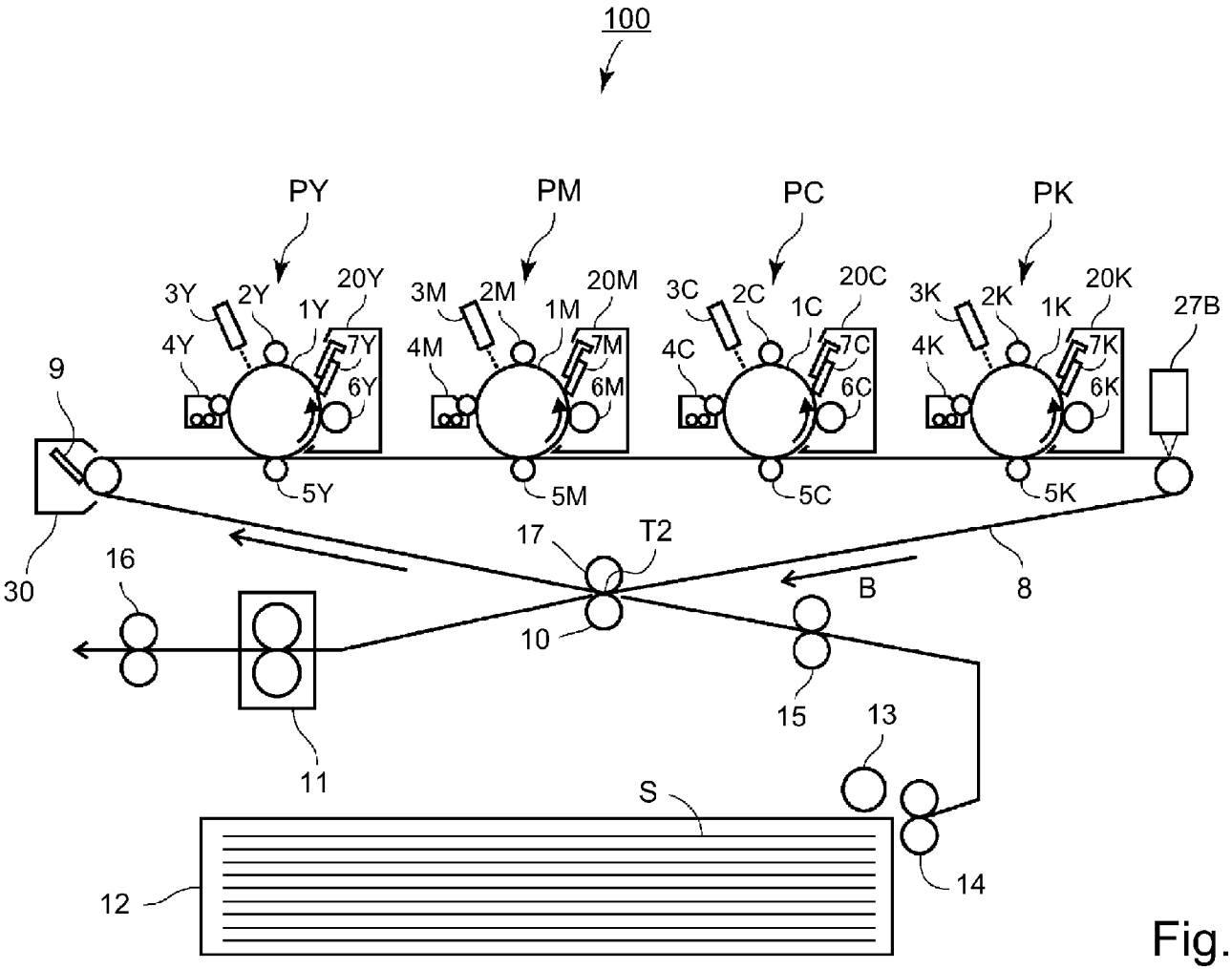
FIG. 1 illustrates a structure of an image forming apparatus according to Embodiment 1.

FIG. 1 illustrates a structure of an image forming apparatus according to Embodiment 1. As shown in FIG. 1, the image forming apparatus 100 is a tandem type and intermediary transfer type full color printer, in which image forming stations PY, PM, PC and PK are provided on the face-up surface of an intermediary transfer belt 8.

An image forming station PY forms a yellow toner image on a photosensitive drum 1Y and transfers the yellow toner image onto the intermediary transfer belt 8. An image forming station PM forms a magenta toner image on a photosensitive drum 1M and transfers the magenta toner image onto the intermediary transfer belt 8. Image forming stations PC and PK form a magenta toner image and a black toner image on photosensitive drums 1C and 1K, respectively, and transfer the magenta toner image and the black toner image onto the intermediary transfer belt 8.

The four color toner images transferred onto the intermediary transfer belt 8 are carried to a secondary transfer portion T2 and are transferred onto a recording material S. The recording material S is picked up from a cassette 12 by a pick-up roller 13 and a separation roller 14 one by one, and is fed to registration rollers 15. The registration roller 15 feeds the recording material S to a secondary transfer portion T2 in timed relation with the toner image on the intermediary transfer belt 8.

An outer secondary-transfer roller 10 nips the intermediary transfer belt 8 between the inner secondary-transfer roller 17 to form the secondary transfer portion T2. By applying a DC voltage to the outer secondary-transfer roller 10, the toner image carried on the intermediary transfer belt 8 is transferred onto the recording material S. The recording material S now carrying the transferred toner image is fed into a fixing device 11, where the recording material S is subjected to heat and pressure so that the image is fixed, and then the recording material S is discharged to an outside of the main assembly A by discharging rollers 16. In a belt cleaning device 30, a cleaning blade 9 rubs the intermediary transfer belt 8 to clean the intermediary transfer belt 8.

Figure 2:
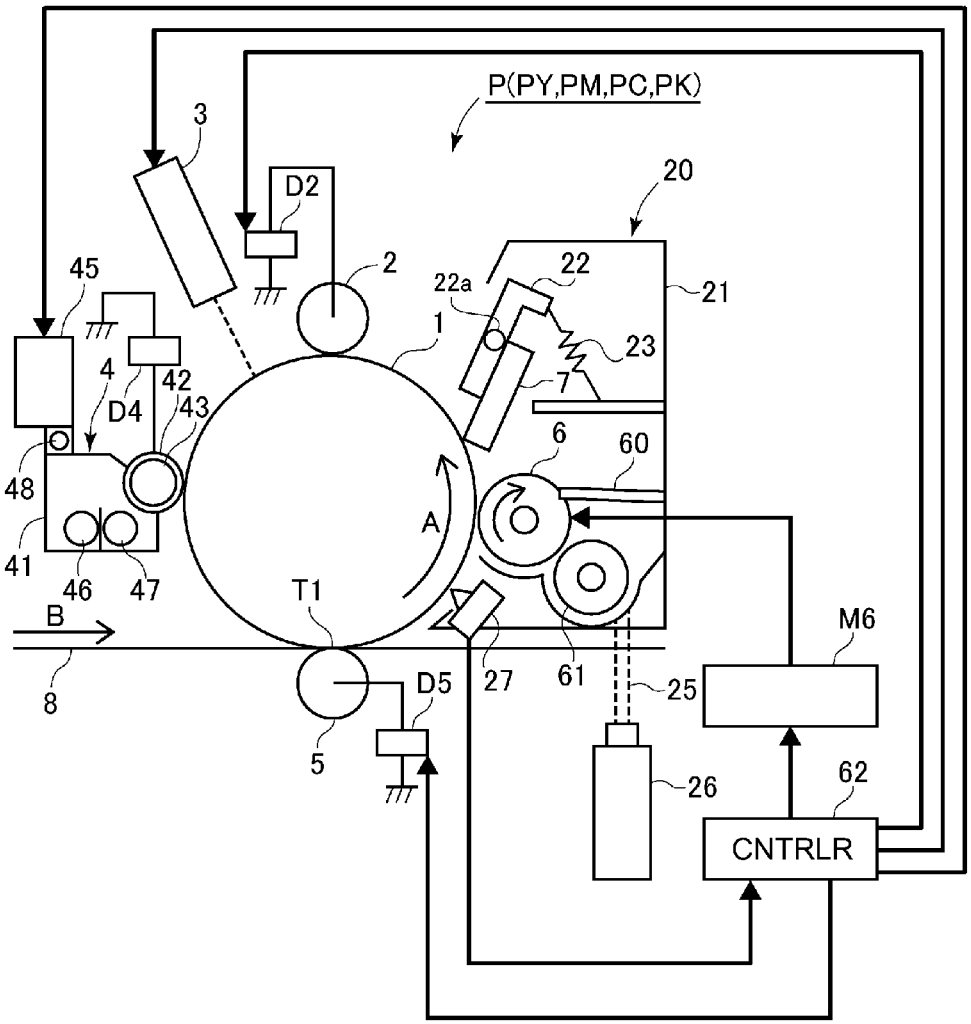
FIG. 2 illustrates a structure of an image forming station of the image forming apparatus.

The image forming stations PY, PM, PC, PK have substantially the same structures except that the colors of the toner in the developing devices 4Y, 4M, 4C, 4K are different from each other. Referring to FIG. 2, the structure of the image forming station will be described commonly referring to the image forming station P without Y, M, C, K.

(Image Forming Station)

FIG. 2 illustrates a structure of an image forming station of the image forming apparatus. As shown in FIG. 2, the image forming station P comprises a charging roller 2, an exposure device 3, a developing device 4, a primary transfer roller 5 and a drum cleaning device 20 along with the surface of the photosensitive drum 1. The photosensitive drum 1 has a length of 360 mm measured in a rotational axis direction thereof and an outer diameter of 84 mm, and is driven by an unshown motor to rotate normally at a process speed (peripheral speed) in a direction indicated by an arrow A.

In this embodiment, the photosensitive drum 1 is an organic photosensitive member (OPC) having a negative charge polarity, and comprises an electroconductive base of a metal cylinder, a photoconductive layer (photosensitive layer) mainly comprising an organic photoconductor. The photoconductive layer comprises laminated charge generation layer of organic material, charge transfer layer and surface protection layer.

The charging roller 2 includes a rotatable metal roller and an elastic layer thereon, and is driven by the photosensitive drum 1. The charging roller 2 is supplied with an oscillating voltage comprising a DC voltage component and an AC voltage component by a charging voltage source D2 to uniformly charge the peripheral surface of the photosensitive drum 1 to a predetermined potential. In this embodiment, the voltage comprises a DC voltage component of −500V and an AC voltage having a peak-to-peak voltage not less than twice a discharge starting voltage, by which the peripheral surface of the photosensitive drum 1 is charged to approx. −500V.

The exposure device 3 scanningly exposes the photosensitive drum 1 charged to the potential by the charging roller 2 to a laser beam on the light and in accordance with image information to form an electrostatic latent image. The light potential exposed to the laser beam is −200V.

The developing device 4 supplies the toner charged to the negative polarity to the electrostatic latent image of the photosensitive drum 1 to develop the electrostatic latent image into a toner image. A transfer roller 5 nips the intermediary transfer belt 8 between the photosensitive drum 1 to form a primary transfer portion T1. A transferring voltage source D5 applies a DC voltage having a positive polarity to the transfer roller 5 to primary-transfer the toner image from the photosensitive drum 1 onto the intermediary transfer belt 8.

(Developing Device)

The developing device 4 develops the electrostatic latent image on the photosensitive drum 1 with a two component developer containing toner and carrier particles. The developer comprises toner particles having an average particle size of approx. 6 μm provided by pulverizing and classifying kneaded material of polyester resin material as a main component, and a resin material binder and pigment. An average charge amount of the toner deposited on the photosensitive drum 1 is approx. −30 μC/g.

A developing container 41 stirs and circulates the two component developer by feeding screws 46 and 47 to electrically charge the toner particles to the negative polarity, and charges the carrier particles to the positive polarity. A developing sleeve 42 rotatably carries the two component developer using the magnetic force of a magnet 43 provided stationarily in the sleeve to supply the developer into a developing portion where the developing sleeve 42 is opposed to the photosensitive drum 1. The developing sleeve 42 has a length of 325 mm measured in the rotational axis direction thereof. A developing voltage source D4 applies an oscillating voltage comprising a DC voltage component and an AC voltage component to the developing sleeve 42 to transfer the toner from the developing sleeve 42 onto the electrostatic latent image of the photosensitive drum 1. In this embodiment, the oscillating voltage comprises a DC voltage of −400V and an AC voltage component of 1600 Vpp.

(Drum Cleaning Device)

FIG. 3 illustrates an operation of a drum cleaning device. In FIG. 3, part (a) illustrates an operation in a measuring mode, and part (b) illustrates an operation in a toner supply mode. As shown in FIG. 2, on the surface of the photosensitive drum 1 after the toner image is transferred onto the intermediary transfer belt 8 in the primary transfer portion T1, untransferred toner, externally added material, electric discharge product and so on are deposited. The drum cleaning device 20 removed is the deposited matter from the photosensitive drum 1 prior to the start of the next image forming process operation.

A cleaner container 21 of the drum cleaning device 20 is provided with a frame 22 having a cleaning blade 7 fixed thereto, the frame 22 being rotatable about a rotational shaft 22*a*. The frame 22 is urged by a tension spring 23 to contact a free end of the cleaning blade 7 to the photosensitive drum 1. The cleaning blade 7 is widely used because it is simple in the structure and inexpensive, and because it does not require driving power.

A fur brush 6 is provided at a position upstream of the cleaning blade 7 with respect to a rotational moving direction of the photosensitive drum 1. The fur brush 6 is rotated in contact with the photosensitive drum 1. The deposited matter such as the untransferred toner remaining on the surface of the photosensitive drum 1 after the toner image is transferred onto the intermediary transfer belt 8 is stirred on the photosensitive drum 1 by the fur brush 6, so that a physical depositing force to the photosensitive drum 1 is weakened. The deposited matter deposited on the photosensitive drum 1 by the weakened depositing force is efficiently scraped off the surface of the photosensitive drum 1 by the cleaning blade 7.

A scraper 60 is provided to enter the fur brush 6 at the side remote from the photosensitive drum 1. A helical feeding member 61 is provided to extend in parallel with the rotational axis of the photosensitive drum 1. The helical feeding member 61 is in the form of a screw of resin material planted into a metal rotation shaft, and is connected with the fur brush 6 through a gear engagement outside the cleaner container 21 to be rotatable relative to the fur brush 6 counterdirectionally, thus feeding the deposited matter such as the untransferred toner to one end portion with respect to the rotational axis direction.

As shown in part (a) of FIG. 3, the fur brush 6 directly removes a part of the deposited matter such as the toner, from the photosensitive drum 1. Fur brush 6 functions also as an abrasion member for removing the deposited matter from the photosensitive drum 1. The deposited matter such as the untransferred toner transferred into the fur brush 6 from the photosensitive drum 1 passes the contact position relative to the scraper 60, with the rotation of the fur brush 6. At this time, the deposited matter such as the untransferred toner is shaken off the fur brush 6, by the repelling force of the elastically deformed fibers of the fur brush 6.

As shown in FIG. 2, the deposited matter, such as the untransferred toner, is shaken off onto the helical feeding member 61, is fed to one end portion side (rear side) with respect to the rotational axis direction of the photosensitive drum 1 and the helical feeding member 61, and is collected into the toner collection container 26 through a disposal toner feeding path 25.

The fur brush 6 includes a metal rotation shaft having a diameter of 12 mm, and a textile material wrapped around the rotation shaft, the textile material being implanted with the fibers. In the textile material, bundles of 6-denier fibers of Nylon are bonded at the density of 50 kF/inch^2. The fibers have length of 4.5 mm.

The photosensitive drum 1 and the fur brush 6 are rotated in the same peripheral moving directions at the contact position therebetween, as indicated by the arrows. The rotational speed of the fur brush 6 can be set at a desired level by a motor M6. For the peripheral speed of 300 mm/sec (100%) of the photosensitive drum 1, the controller 62 controls the motor M6 at the peripheral speed of the fur brush 6 of 360 mm/sec (120%) during the normal image forming operation.

As described in the foregoing, the transfer roller 5 which is an example of the transferring means transfers the toner image carried on the photosensitive drum 1 which is in the example of the image bearing member onto the intermediary transfer belt 8 which is an example of the transfer medium. The cleaning blade 7 which is an example of the cleaning blade cleans the peripheral surface of the photosensitive drum 1 having passed the transfer roller 5.

The fur brush 6 which is an example of the rotational cleaning member is contacted to and rotated by the peripheral surface of the photosensitive drum 1 after passing the transfer roller 5 and before reaching the cleaning blade 7. The fur brush 6 rotates codirectionally with the photosensitive drum 1 at the contact position therebetween. The scraper 60 which is an example of the plate member enters the fur brush 6 and beats off the toner out of the fur brush 6 with the rotation of the fur brush 6.

(Toner Content Control)

FIG. 4 illustrates a normal toner image, a toner image for measurement and a toner image for the toner supply. Part (a) of FIG. 4 is a comparison of the voltages, and part (b) is a comparison of the peripheral speeds of the fur brush. As shown in FIG. 2, the controller 62 controls the image forming station P to form a toner image on the photosensitive drum 1.

As shown in part (a) of FIG. 4, in normal image forming mode, the photosensitive drum 1 is electrically charged to a dark portion potential VD, and the potential is reduced to a light portion potential VL by the exposure device 3, thus forming the electrostatic latent image. The toner is transferred from the developing sleeve 42 supplied with a DC voltage Vdc, by which the toner is deposited on the electrostatic latent image so as to compensate for the potential difference between the DC voltage Vdc and the light portion potential VL.

As shown in FIG. 2, the controller 62 executes an operation in a measuring mode for each 100 sheets continuous image formations for the purpose of maintaining a constant image density of the output images. In the measuring mode, a toner image (patch image) for measurement is formed on the photosensitive drum 1, and infrared light is projected onto the photosensitive drum 1, and the reflected infrared light is detected by an optical sensor 27 to measure an amount of the toner deposition per unit area of the measurement toner image.

As shown in part (a) of FIG. 4, in the measuring mode, the photosensitive drum 1 is charged to the dark portion potential VD, and the potential is decreased to a light portion potential VL' by the exposure device 3 to form an electrostatic latent image for the measurement toner image. The toner is transferred from the developing sleeve 42 supplied with a DC voltage Vdc, by which the toner is deposited on the electrostatic latent image so as to compensate for the potential difference between the DC voltage Vdc and the light portion potential VL'.

The measurement toner image formed on the photosensitive drum 1 passes through the primary transfer portion T1 while the transfer roller 5 is supplied with a negative polarity voltage, and specular reflected light is detected by the optical sensor 27. The amount of the specular reflection decreases with the increase of the toner amount per unit area of the measurement toner image, and therefore, the controller 62 can deduce the image density of the output image on the basis of the output of the optical sensor 27.

When the toner amount per unit area of the measurement toner image is excessively large, the controller 62 reduces the toner supply amount into the developing device 4 by a toner supplying portion 45 to enhance the toner charge amount in the developing device 4. When the toner amount per unit area of the measurement toner image is excessively small, the toner supply amount into the developing device 4 by the toner supplying portion 45 is increased to decrease the toner charge amount in the developing device 4.

As shown in part (a) of FIG. 3, the measurement toner image on the photosensitive drum 1 having passed by the optical sensor 27 reaches the drum cleaning device 20, which removes the measurement toner image from the photosensitive drum 1.

As described in the foregoing, the controller 62 which is an example of the executing portion is capable of executing the normal image forming mode operation and the measuring mode operation.

In the image forming mode which is an example of a first mode, the toner image is transferred from the photosensitive drum 1 onto the intermediary transfer belt 8.

In the measuring mode which is an example of a third mode, the measurement toner image which is an example of the toner image for the measurement is carried on the photosensitive drum 1 and is detected by the optical sensor 27 which is an example of the detecting means. The optical sensor 27 optically detects the measurement toner image carried on the photosensitive drum 1.

(Toner Supply Mode)

The operation in the supply mode is usually executed during a post-rotation period of the photosensitive drum 1. In the supply mode, a band-like image extending over the full length in the image region main scan direction is formed on the photosensitive drum 1, and is carried on the photosensitive drum 1 to the cleaning blade 7 to provide a lubricious property between the photosensitive drum 1 and the cleaning blade 7.

As shown in FIG. 2, a frictional resistance between the cleaning blade 7 and the photosensitive drum 1 is large, and when they are in direct rubbing relationship, it is difficult to smoothly rub the cleaning blade 7 on the surface of the photosensitive drum 1. Therefore, in practice, the lubrication is maintained between them by a small amount of the toner particles or the fine particles added to the toner stagnating at the free end portion of the cleaning blade 7.

The amount of the toner particles and/or the fine particles added to the toner stagnating at the free end portion of the cleaning blade 7 varies depending on the images actually formed, and the amount decreases during the non-image-formation period. In addition, when image formations with low duty ratio image signals such as letter images and/or whitish images continue, the amount of the toner and/or fine particles stagnating at the free end of the cleaning blade 7 tends to be short.

Without the toner and/or fine particles stagnating at the free end of the cleaning blade 7, the frictional force relative to the photosensitive drum 1 is large with the result of vibration (chattering) of the cleaning blade 7 and even to an extent of local eversion of the cleaning blade 7.

Particularly, under a high temperature and high humidity condition, the frictional force tends to increase, and therefore, lost and/or wearing of the edge of the cleaning blade 7, with the possible result of failure of the cleaning performance against the toner, externally added material and/or the electric discharge product. If no care is taken against the increase of the friction between the cleaning blade 7 and the photosensitive drum 1, the damage to the blade edge of the cleaning blade 7 increases, and therefore, it is difficult to maintain the stabilized cleaning performance of the cleaning blade 7 for a long-term.

In view of this, in Embodiments 1, when the condition under which the amount of the toner and/or fine particles stagnating at the free end of the cleaning blade 7 is short, the supply mode operation, carried out to supply the supply toner image, is provided for the cleaning blade 7. In the supply mode which is an example of the second mode, the supply toner image which is an example of the toner image for the toner supply is carried on the photosensitive drum 1 to supply it to the cleaning blade 7. The supply toner image is a band-like toner image extending in the direction perpendicular to the rotational moving direction of the photosensitive drum 1.

As shown in part (a) of FIG. 4, in the supply mode, the DC voltage of the charging voltage source D2 is lower than the development DC voltage Vdc to form a band-like electrostatic latent image by non-image—the exposure over the full length of the photosensitive drum 1 in the main scan direction. The band-like electrostatic latent image is developed by the developing device 4 to form the supply toner image extending over the full length of the photosensitive drum 1 in the main scan direction. The supply toner image is passed through the primary transfer portion T1 while the transfer roller 5 is supplied with a negative polarity voltage and reaches the free end of the cleaning blade 7.

At this time, however, as shown in part (a) of FIG. 3, the supply toner image formed on the photosensitive drum 1 may be scraped off by the fur brush 6 and may not reach the cleaning blade 7. In view of this, according to an Embodiment 1, as shown in part (b) of FIG. 3, in the supply mode, the rotational speed of the fur brush 6 is decreased to reduce the percentage of the supply toner image scraped off by the fur brush 6.

(Rotational Speed of Fur Brush)

FIG. 5 shows a relationship between a peripheral speed difference between a fur brush and a photosensitive drum and a toner scraping amount. As shown in FIG. 2, the peripheral speed of the fur brush 6 and the cleaning performance of the supply toner image have been checked using a multifunction machine available from Canon-Kabushiki Kaisha. The tests were carried out under high temperature and high humidity ambience (32.5 degree C. of ambient temperature and 80% of absolute humidity) which was the condition of the increased frictional force between the cleaning blade 7 and the photosensitive drum 1 tending to cause toner fusing, for the purpose of testing under severe conditions deliberately.

As shown in FIG. 5, for the photosensitive drum 1 rotated at the peripheral speed of 300 mm/sec (100%), the percentage of the peripheral speed of the fur brush 6 is changed to a plurality of levels, and the scraped amounts of the supply toner image by the fur brush 6 are measured. As a result, it has been confirmed that the scrape amount by the fur brush 6 decreases with decrease of the peripheral speed of the fur brush 6 toward 100%.

The increase of the damages of the cleaning blade 7 and the photosensitive drum 1 in the continuous image formation has been checked between when the peripheral speed of the fur brush 6 is made different depending on the image forming mode, the measuring mode and the supply mode and when the peripheral speed of the fur brush 6 is the same respective irrespective of the modes. Using the multifunction machine available from Canon-Kabushiki Kaisha, the photosensitive drum 1 is rotated at the peripheral speed of 300 mm/sec, and double-sided image formations are carried out for 100,000 A3 sheets under the respective conditions. The eversion of the edge of the cleaning blade 7 and the toner fusing of the photosensitive drum surface immediately after the continuous image formations were observed by a microscope.

TABLE 1

| | Peripheral speed of fur brush | Prevention of blade everting | Prevention of toner fusion |
|---|---|---|---|
| Comp. Ex. 1 | Normal: 120% Supply Md: 120% | NG | G |
| Comp. Ex. 2 | Normall: 100% Supply Md: 100% | G | NG |
| Emb. 1 | Normal: 120% Supply Md: 100% | G | G |

G: good
NG: no good

In comparison example 1, the peripheral speed ratio of the fur brush 6 is 120% in both of the image forming mode and the supply mode. In this case, the cleaning performance of the fur brush 6 is high enough, and therefore, no toner fusing is observed, but the edge of the cleaning blade 7 is everted because of the shortage of the toner supply to the cleaning blade 7.

In comparison example 2, the peripheral speed ratio of the fur brush 6 is 100% in both of the image forming mode and the supply mode. In this case, because of the decrease of the cleaning performance of the fur brush 6, no eversion of the edge is observed because the toner supply to the cleaning blade 7 is enough, but a large amount of the toner is fused on the surface of the photosensitive drum 1.

According to an Embodiment 1, the peripheral speed ratio of the fur brush 6 is 120% in the image forming mode to assure the cleaning performance, and the peripheral speed ratio of the fur brush 6 is 100% in the supply mode to assure the sufficient toner supply to the cleaning blade 7. The result is that the eversion of the edge of the cleaning blade 7 is prevented without toner fusing on the surface of the photosensitive drum 1.

The toner of the toner image on the surface of the photosensitive drum 1 is added externally with the additive, and when the additive is separated from the toner, the additive is deposited on the surface of the photosensitive drum 1. Then, the toner accumulation starts at the deposited additive, and the accumulated toner is blocked by the additive, and is gradually solidified on the surface of the image bearing member. If the toner solidification occurs on the surface of the photosensitive drum 1, the image quality is deteriorated because of the white dots on the output prints.

Control in Embodiment 1

FIG. 6 is a block diagram of a control system for the image forming apparatus. FIG. 7 is a flow chart of the control in Embodiment 1.

As shown in FIG. 2, in embodiment 1, the peripheral speed of the fur brush 6 is different between the image forming mode for the normal image formation, the measuring mode for the control patch image formation, and the supply mode forming the supplied toner image.

The controller 62 which is an example of the controller controls the peripheral speed of the fur brush 6 by the motor M6.

Referring to FIG. 7 together with FIG. 6, in the supply mode (YES, in S11), the controller 62 sets the peripheral speed of the fur brush 6 at 100% to supply the supply toner image to the cleaning blade 7 (S19).

In measuring mode (YES, in S12), the controller 62 sets the peripheral speed of the fur brush 6 at 120% to measure the measurement toner image by the optical sensor 27 (S18).

In the normal image forming mode (YES, in S13), the controller 62 sets the peripheral speed of the fur brush 6 at 120% to form the normal toner image and transfer it onto the recording material (S17).

After the completion of the image forming operation (YES, in S20), the controller 62 stops the image forming apparatus 100. If the image formation is not completed (NO, in S20), the above-described sequential operation is repeated.

As described in the foregoing, in Embodiments 1, the controller 62 makes the peripheral speed difference between the photosensitive drum 1 and the fur brush 6 smaller while the supply toner image is passing by the fur brush 6 than while the surface of the photosensitive drum 1 is passing by the fur brush 6 in the normal image forming mode.

The controller 62 makes the peripheral speed difference between the photosensitive drum 1 and the fur brush 6 smaller while the supply toner image is passing by the fur brush 6 than while the measurement toner image is passing by the fur brush 6 in the measuring mode.

The controller 62 makes the peripheral speed difference smaller between the photosensitive drum 1 and the fur brush 6 while the supply toner image is passing by the fur brush 6. The controller 62 decreases the peripheral speed difference by decreasing the peripheral speed of the fur brush 6 so as to make the percentage of the peripheral speed of the fur brush 6 relative to the peripheral speed of the photosensitive drum 1 not less than 95% and less than 105%.

Effects of Embodiment 1

In embodiment 1, in the structure for preventing the toner fusing on the photosensitive drum 1 using the fur brush 6, an efficient supply mode is carried out so that the frictional force between the cleaning blade 7 and the photosensitive drum 1 can be suppressed. The amount of the toner consumption for the supply mode can be saved, and the time required for the supply mode operation can be reduced.

In the supply mode, the peripheral speed ratio of the fur brush 6 is made 100%, by which the fur brush 6 is prevented from scraping off the supply toner image, and therefore, the toner can be efficiently supplied to the cleaning blade 7 which is short of the lubricant material. The results of the evaluation experiments, the torque increase for the rotation of the photosensitive drum 1 attributable to the cleaning blade 7 is prevented, and the vibration (chattering) of the cleaning blade 7 is prevented. In the microscope evaluation, no eversion of the cleaning blade 7, no loss of the blade edge or no wearing of the blade edge is observed. The toner amount supplied into the cleaning blade 7 is not reduced even when the scraping power of the fur brush 6 is enhanced in the image forming mode and the measuring mode for the purpose of removing the fused material from the photosensitive drum 1.

On the other hand, in the image forming mode, the peripheral speed of the fur brush is made 120%, by which the scraping power for removing the fused toner from the photosensitive drum 1 is enhanced. In the other mode operation including the measuring mode, the peripheral speed of the fur brush 6 is not decreased, and the scraping power is maintained at the proper level. Therefore, no fusing of the toner on the photosensitive drum 1 is observed in the evaluation experiments carried out under the severe conditions. No white dot or image defect attributable to the fused toner on the photosensitive drum 1 is observed, either.

Embodiment 2

As shown in FIG. 2, in embodiment 1, the measuring mode is carried out using optical sensor 27 opposed to the photosensitive drum 1. In embodiment 2, as shown in FIG. 1, the measuring mode is carried out using an optical sensor 27B opposed to the intermediary transfer belt 8. In the measuring mode, the measurement toner images of the respective colors are formed in the image forming stations PY, PM, PC, PK and are transferred onto the intermediary transfer belt 8.

The measurement toner images of the respective colors on the intermediary transfer belt 8 are detected by the optical sensor 27B opposed to the intermediary transfer belt 8, and the results are fed back to the toner supply amounts in the image forming stations PY, PM, PC, PK.

In Embodiment 2, the peripheral speed difference between the photosensitive drum 1 and the fur brush 6 is made smaller while the supply toner image is passing by the fur brush 6 than while the adjustment mode operation is being carried out. During the execution of the adjustment mode, the peripheral speed of the fur brush is set at 120%, and during the execution of the supply mode, the peripheral speed of the fur brush is set at 100%.

The peripheral speed difference between the photosensitive drum 1 and the fur brush 6 is made smaller while the supply toner image is passing by the fur brush 6 than while the peripheral surface of the photosensitive drum 1 at the position after the measurement toner image is transferred onto the intermediary transfer belt 8 is passing by the fur brush 6.

Embodiment 3

As shown in FIG. 1, the image forming apparatus 100 executes the operation in the adjustment mode in which the respective color toner images formed by the image forming stations PY, PM, PC, PK are aligned with each other. In the adjustment mode, the toner images for the alignment are formed by the image forming stations PY, PM, PC, PK, and are transferred onto the intermediary transfer belt 8.

The alignment toner images of the respective colors on the intermediary transfer belt 8 are detected by the optical sensor 27B opposed to the intermediary transfer belt 8 to measure the time differences of the detection timings, and the results are fed back to the writing start timings in the image forming stations PY, PM, PC, PK.

In Embodiment 3, the peripheral speed difference between the photosensitive drum 1 and the fur brush 6 is made smaller while the supply toner image is passing by the fur brush 6 than while the adjustment mode operation is being carried out. During the execution of the adjustment mode, the peripheral speed of the fur brush is set at 120%, and during the execution of the supply mode, the peripheral speed of the fur brush is set at 100%.

The peripheral speed difference between the photosensitive drum 1 and the fur brush 6 is made smaller while the alignment toner image is passing by the fur brush 6 than while the peripheral surface of the photosensitive drum 1 at the position after the measurement toner image is transferred onto the intermediary transfer belt 8 is passing by the fur brush 6.

Other Embodiments

In embodiment 1, the photosensitive drum is charged by the charging roller, but a corona charger, a non-contact type charging roller, a charging blade or the like is usable in place of the charging roller used in Embodiment 1.

In embodiment 1, the electrostatic latent image is formed on the photosensitive drum using the semiconductor laser and the rotational mirror, but another electrostatic latent image forming means such as LED array or the like is usable in place thereof.

In embodiment 1, the rotation cleaning member is in the form of a fur brush, but the rubber roller and/or magnetic brush is usable as the rotation cleaning member.

In embodiment 1, the peripheral speed ratio of the fur brush is switched between 120% and 100%, but other values are usable. The switching of the rotational speed of the fur brush may be completed by gear switching in place of the motor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-127845 filed on Jun. 25, 2015, which is hereby incorporated by reference herein in its entirety.

What is claimed is:

1. An image forming apparatus comprising:

a rotatable image bearing member configured to carry a toner image;

a transfer device configured to transfer the toner image from said image bearing member onto a transfer material;

a cleaning blade configured to remove toner from said image bearing member after transfer of the toner image;

a rotatable fur brush provided at a position downstream of said transfer device and upstream of said cleaning blade with respect to a rotational moving direction of said image bearing member, said fur brush being rotatable to provide a peripheral moving direction thereof counterdirectional with respect to a peripheral moving direction of said image bearing member;

an executing portion capable of executing an operation in a first mode for forming a toner image on the transfer material on the basis of an image formation signal inputted to said image forming apparatus and in a second mode for supplying a band of the toner to said cleaning blade; and a controller configured to control a peripheral speed difference between said image bearing member and said fur brush, wherein the peripheral speed difference between said image bearing member and said fur brush when the band of the toner passes said fur brush in the second mode is less than the peripheral speed difference between said image bearing member and said fur brush when residual toner remaining on said image bearing member after transfer of the toner image passes said fur brush in the first mode.

2. An apparatus according to claim 1, further comprising a detector for detecting a measurement toner image for measurement carried on said image bearing member, wherein said executing portion is capable of executing an operation in a third mode in which the measurement toner image is detected by said detector, and wherein said controller controls the peripheral speed difference such that the peripheral speed difference when the band of the toner passes said fur brush in the second mode is less than the peripheral speed difference when residual toner remaining on said image bearing member after transfer of the measurement toner image passes said fur brush in the third mode.

3. An apparatus according to claim 1, wherein said controller controls said fur brush such that the peripheral speed difference when the band of the toner passes said fur brush in the second mode is less than the peripheral speed difference before the band of the toner passes said fur brush in the second mode.

4. An apparatus according to claim 1, wherein said controller controls the peripheral speed of said fur brush so as to decrease the peripheral speed difference while the peripheral speed of said image bearing member remains unchanged.

5. An apparatus according to claim 1, wherein said controller controls the peripheral speed difference such that a ratio of the peripheral speed of said fur brush to the peripheral speed of said image bearing member in the second mode is not less than 95% and less than 105%.

6. An apparatus according to claim 1, wherein the band of the toner extends in a direction parallel to a rotational axis direction of said image bearing member.

7. An apparatus according to claim 1, further comprising a plate member extending into said fur brush configured to beat off the toner with rotation of said fur brush.

8. An apparatus according to claim 1, wherein said controller controls the peripheral speed difference such that the peripheral speed of said fur brush is faster than the peripheral speed of said image bearing member when residual toner remaining on said image bearing member after transfer of the toner image passes said fur brush in the first mode.

9. An image forming apparatus comprising:

a rotatable image bearing member configured to carry a toner image;

a transfer device configured to transfer the toner image from said image bearing member onto a transfer material;

a cleaning blade configured to remove toner from said image bearing member after transfer of the toner image;

a rotatable fur brush provided at a position downstream of said transfer device and upstream of said cleaning blade with respect to a rotational moving direction of said image bearing member, said fur brush being rotatable to provide a peripheral moving direction thereof counterdirectional with respect to a peripheral moving direction of said image bearing member;

an executing portion capable of executing an operation in a first mode for forming a toner image on the transfer material on the basis of an image formation signal inputted to said image forming apparatus and in a second mode for supplying a band of the toner to said cleaning blade; and a controller configured to control a peripheral speed of said fur brush, wherein the peripheral speed of said fur brush when the band of the toner passes said fur brush in the second mode is slower than the peripheral speed of said fur brush when residual toner remaining on said image bearing member after transfer of the toner image passes said fur brush in the first mode.

* * * * *